US005088411A

United States Patent [19]

Kurokawa et al.

[11] Patent Number: 5,088,411

[45] Date of Patent: Feb. 18, 1992

[54] APPARATUS FOR IGNITING DETONATING PRIMER WITH THE AID OF ELECTROMAGNETIC WAVE

[75] Inventors: Kouichi Kurokawa; Youji Tasaki, both of Aichi, Japan

[73] Assignee: Nippon Oil and Fats Company, Tokyo, Japan

[21] Appl. No.: 532,616

[22] Filed: Jun. 4, 1990

[30] Foreign Application Priority Data

Jun. 9, 1989 [JP] Japan ..... 1-145267

[51] Int. Cl.[5] ..... F42D 5/00; F42B 3/18

[52] U.S. Cl. ..... 102/200; 102/202.2

[58] Field of Search ..... 102/200, 202.1, 202.2, 102/202.5, 202.14, 301, 322; 86/50

[56] References Cited

U.S. PATENT DOCUMENTS 4,576,093 3/1986 Synder ..... 102/200

4,615,268 10/1986 Nakano et al. ..... 102/200

FOREIGN PATENT DOCUMENTS 3131332 4/1982 Fed. Rep. of Germany ... 102/202.5

61-57558 3/1986 Japan .

*Primary Examiner*—Charles T. Jordan

*Attorney, Agent, or Firm*—Stevens, Davis, Miller & Mosher

[57] ABSTRACT

An apparatus for igniting a plurality of detonating primers including an oscillator for generating a microwave, a transmitting antenna for radiating the microwave generated by the oscillator toward receiving antennas connected to the detonating primers, and a shield housing provided between the transmitting antenna and the receiving antennas to surround a microwave propagating space. The shield housing is constructed such that the microwave radiated by the transmitting antenna is not leaked out of the shield housing and spurious electromagnetic waves do not intrude into the space within the shield housing. The detonating primers are positively ignited by the electric power radiated from the transmitting antenna and received by the receiving antennas even if the output power of the oscillator is small. The shield housing also serves to confine noise, scattering stones and fumes within the shield housing.

19 Claims, 2 Drawing Sheets

APPARATUS FOR IGNITING DETONATING PRIMER WITH THE AID OF ELECTROMAGNETIC WAVE

BACKGROUND OF THE INVENTION

1. Field of the Invention and Related Art Statement

The present invention relates to an apparatus for igniting a detonating primer with the aid of an electromagnetic wave comprising an oscillator for generating an electric oscillation signal, a transmitting antenna which is excited by said electric oscillation signal supplied from said oscillator to radiate an electromagnetic wave toward a receiving antenna provided on said detonating primer.

The igniting apparatus of the kind mentioned above has been described in Japanese Patent Application Laid-open Publication Kokai Sho 61-57,558. FIG. 1 is a schematic view showing this known igniting apparatus. The apparatus comprises a microwave oscillator 1 and a transmitting antenna 2 for radiating a microwave toward a plurality of igniting devices 3. Each of the igniting devices 3 includes a receiving antenna 4, a detonating primer 5, a signal cable 6 connected between the receiving antenna and the detonating primer, and explosives 7. The microwave radiated by the transmitting antenna 2 is received by the receiving antennas 4 of the igniting devices 3 and the received electric power is supplied via the signal cables 6 to igniting fuses of the detonating primers 5. When the igniting fuses of the detonating primers 5 are ignited, the main explosives 7 are exploded. It should be noted that the igniting devices 3 and explosives 7 are inserted into holes 8 formed in a surface 9 of the exploding site in such a manner that the receiving antennas 4 are exposed out of the holes 8.

In the known detonating apparatus explained above, the space in which the microwave propagates does not have a constant environment condition, so that the intensity of the electromagnetic field of the microwave radiated by the transmitting antenna 2 and received by the receiving antennas 4 fluctuates due to the complicated reflection and absorption of the microwave. Therefore, there is a problem that a sufficient amount of the electric power is not supplied to the receiving antenna 4 and the detonating primers 5 might not be ignited. Further, if the receiving antennas 4 receive spurious microwaves radiated from other transmitting antennas than the antenna 2 of the relevant detonating apparatus, one or more detonating primers 5 might be ignited erroneously.

Moreover, the microwave radiated by the transmitting antenna 2 spreads over a rather wide angle, so that there might occur serious problems of interference upon human beings, animals, plants and electric equipment.

SUMMARY OF THE INVENTION

The present invention has for its object to provide a novel and useful apparatus for igniting detonating primers with the aid of an electromagnetic wave, in which a sufficiently large amount of the electric power can be supplied to the detonating primers by means of the oscillator of a relatively small output power to ignite the detonating primers positively, while erroneous ignition of the detonating primers due to the spurious waves from the external environment can be effectively prevented, and the interference upon the human beings, animals, plants and other electric equipment can be also removed.

According to the invention, an apparatus for igniting at least one detonating primer having a receiving antenna connected thereto with the aid of an electromagnetic wave comprises an oscillator for generating an electric oscillation signal;

a transmitting antenna which is excited by said electric oscillation signal supplied from said oscillator to radiate an electromagnetic wave toward the receiving antenna provided on said detonating primer; and a shield housing for surrounding a space between the transmitting antenna and the receiving antenna connected to the detonating primer and having a property for reflecting or absorbing the electromagnetic wave which is made incident upon the shield housing.

According to the invention, said shield housing for surrounding the space between the transmitting and receiving antennas can remove the influence of standing waves due to the complicated reflection and absorption of the electromagnetic wave, and further the leakage of the electromagnetic wave out of the housing and the intrusion of the spurious electromagnetic wave into the housing can be effectively prevented. Therefore, the propagating path of the electromagnetic wave radiated from the transmitting antenna and received by the receiving antenna can be specified and can be maintained constant, so that the intensity of the electromagnetic field of the electromagnetic wave received by the receiving antenna can be remained constant.

DESCRIPTION OF THE PREFERRED EMBODIMENTS

Figure 2:
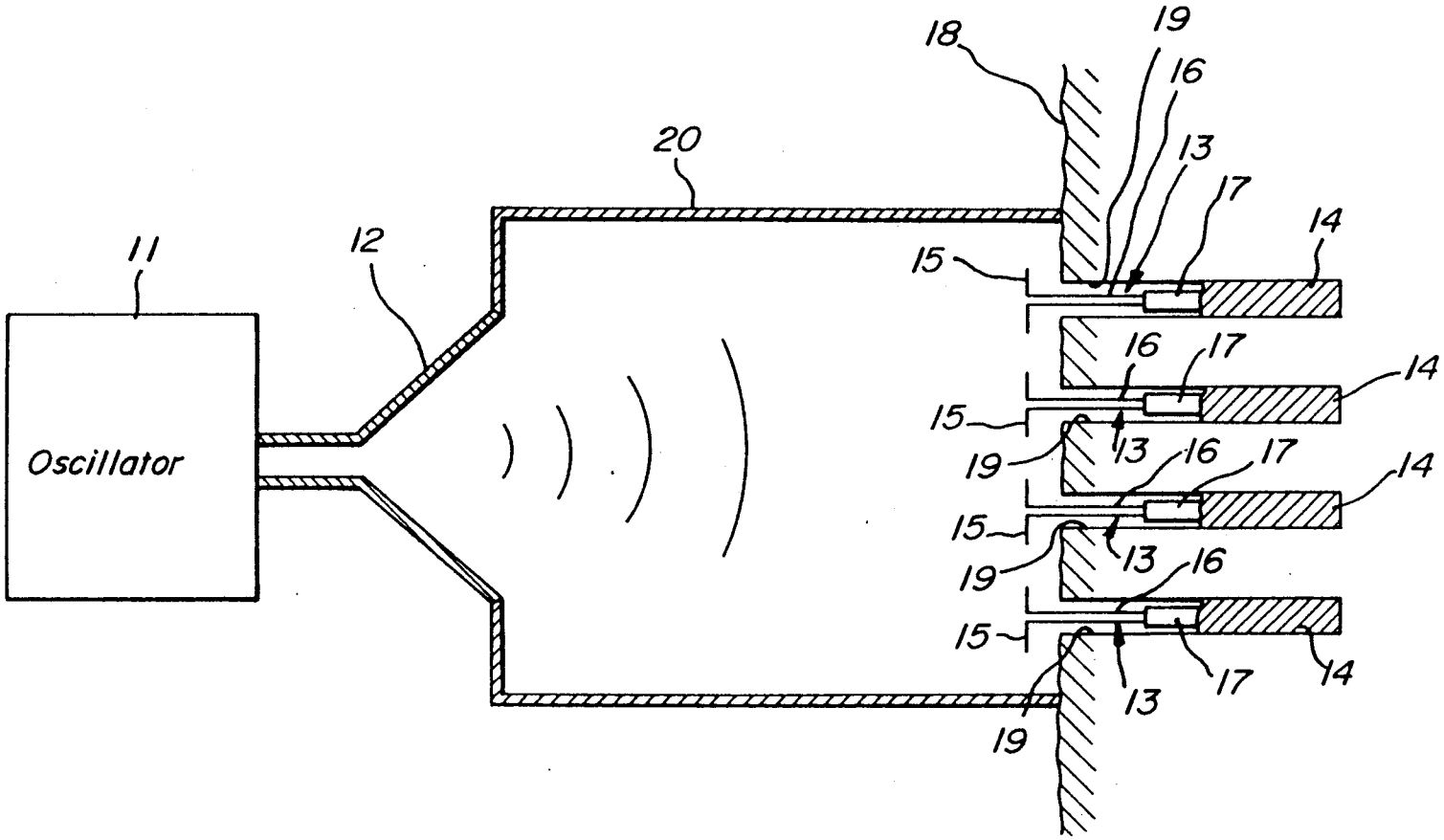
FIG. 2 is a schematic cross sectional view illustrating an embodiment of the apparatus for igniting detonating primers according to the invention.

FIG. 2 is a schematic cross section showing an embodiment of the apparatus for igniting detonating primers according to the invention. In the present embodiment, an electromagnetic wave is radiated from an oscillator 11 via a transmitting antenna 12 and igniting devices 13 are ignited with the aid of the electromagnetic wave to explode main explosive, i.e. dynamites 14. Each of igniting devices 13 comprises receiving antenna 15, signal cable 16 and detonating primer 17 connected to the receiving antenna via the signal cable.

In the present embodiment, there is provided a shield housing 20 which surrounds the electromagnetic wave propagating space between the transmitting antenna 12 and the surface 18 of the exploding site.

Now the detailed construction of the igniting apparatus of the present embodiment will be explained.

The oscillator 11 is constructed to generate the electric signal having a constant frequency within a frequency range of 10 MHz to 100 GHz, preferably within a frequency range of 500 MHz to 20 GHz. When the oscillator 11 generates the microwave, it may be formed by a microwave oscillator having a microwave tube such as magnetron and klystron. The transmission power of the oscillator 11 is higher than 10 W, preferably higher than 100 W, and more preferably higher than 1000 W. The transmission mode of the oscillator 11 may be the continuous oscillation mode, or the pulse oscillation mode having a repetition period of several nano seconds to several seconds. In the pulse oscillation mode, pulses may be generated continuously or intermittently.

The transmitting antenna 12 may be formed in accordance with the frequency of the electromagnetic wave to be transmitted. For instance, in case of transmitting the microwave, the transmitting antenna 12 may be formed by any antenna selected from a group consisting of electromagnetic horn, dipole antenna, Yagi antenna, ground-plane antenna and plane-antenna.

The receiving antenna 15 of the igniting device 13 may be constructed in accordance with the frequency of the electromagnetic wave transmitted by the transmitting antenna 12. It should be noted that the receiving antenna 15 is advantageously formed to be small in size and easy to handle. When the microwave is transmitted from the transmitting antenna 12, the receiving antenna 15 may be formed by any antenna selected from a group consisting of ordinary dipole antenna, folded dipole antenna, and Yagi antenna. Then, the signal cable 16 may be advantageously formed by the parallel feeder or the coaxial cable having the length of 1 cm to 10 m, preferably 5 cm to 2 m. The detonating primer 17 may be formed by the electric primer or blasting cap having substances which are heated or reactive by the received electromagnetic energy.

Figure 1:
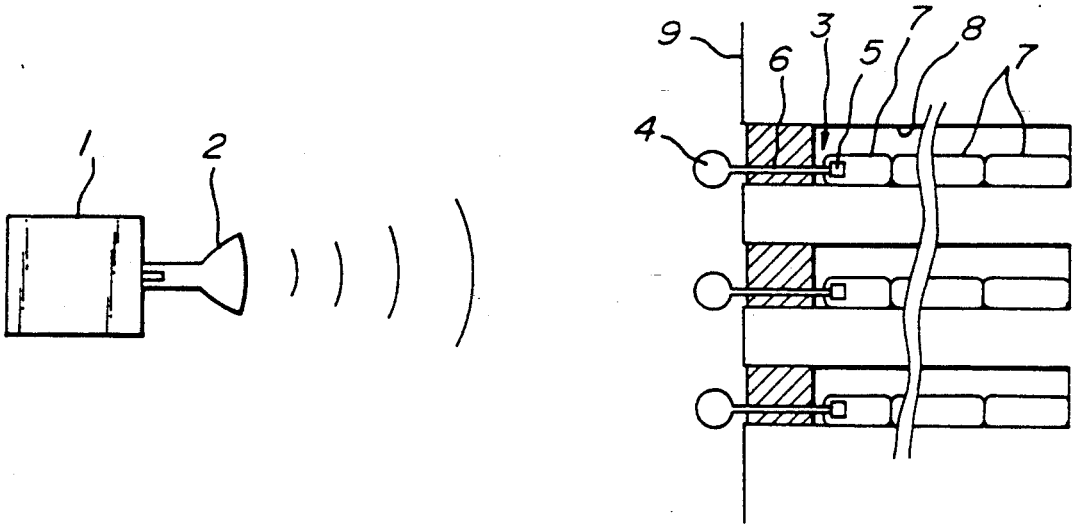
FIG 1 PRIOR ART
FIG. 1 is a schematic view showing a known apparatus for igniting detonating primers.
Figure 3:
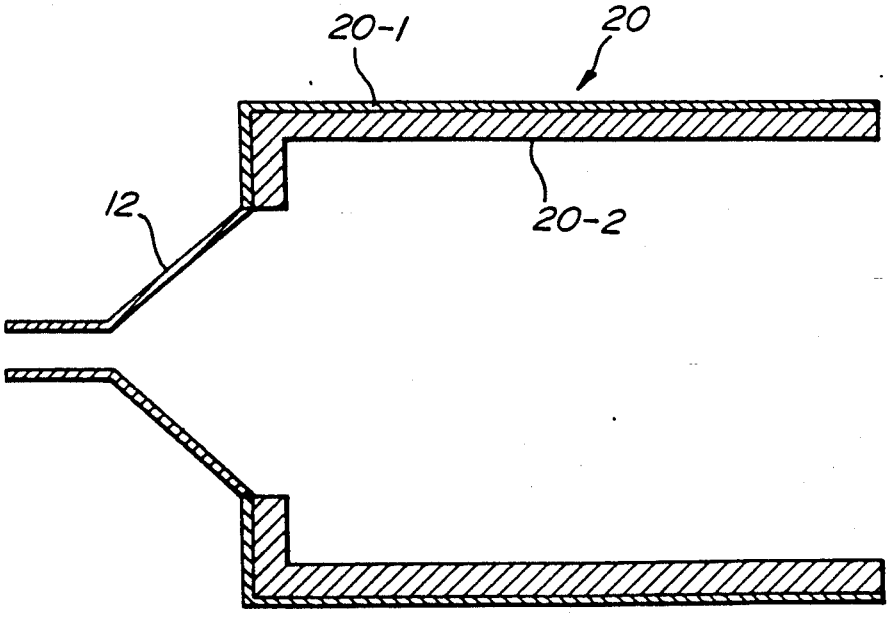
FIG. 3 is a cross sectional view depicting another embodiment of the shield housing according to the invention.

The shield housing 20 may be made of metal such as iron, copper and aluminum. Then the shield housing serves to reflect the electromagnetic wave. When it is required to construct the shield housing 20 to absorb the electromagnetic wave, the housing is formed by a main body 20-1 made of metal and an inner liner 20-2 which is applied on an inner surface of the main body and is made of material which effectively absorbs the electromagnetic wave as illustrated in FIG. 3. The electromagnetic wave absorbing material of the inner liner 20-2 may be constructed by resins in which water or alcohol has been immersed, or dielectric material having a high relative dielectric constant such as titanium oxide and ferrite. It is preferable to form the inner liner 20-2 of the shield housing by resin in which ferrite powder or carbon powder has been mixed. It is also possible to construct the whole body of the shield housing 20 by dielectric material having a relatively large dielectric constant such as titanium oxide and ferrite or by resins in which ferrite power or carbon powder has been mixed.

The shape of the shield housing 20 is not limited at all as long as it can surround the electromagnetic wave propagating space between the transmitting antenna 12 to the receiving antennas 15. Typically, the shield housing 20 may be constructed in the form of cubic, quadratic, cylindrical and spherical body. The size of the shield housing 20 may be determined in accordance with the number and arrangement of detonating primers to be exploded and a cross sectional area of the exploding site. Usually, the shield housing 20 may be formed to have the volume of 0.001 to 10000 $m^3$, preferably 0.005 to 1000 $m^3$, and more preferably 0.01 to 10 $m^3$.

As explained above, according to the present invention, the electromagnetic wave propagating space between the transmitting antenna 12 to the receiving antennas 15 is closed by the shield housing 20, so that the influence of the standing wave due to the complicated reflection and absorption of the electromagnetic wave can be effective removed, and moreover the leakage of the electromagnetic wave out of the shield housing 20 and the intrusion of spurious electromagnetic waves from the environment can be also prevented. Therefore, the electromagnetic wave propagating path between the transmitting antenna 12 and the receiving antennas 15 can be specified and can be maintained constant. Therefore, the intensity of the electromagnetic field of the electromagnetic wave received by the receiving antennas 15 can be kept constant and thus a sufficient amount of electric power can be supplied to a plurality of the receiving antennas 15 even when use is made of the oscillator 11 having a relatively small output power. In this manner, the detonating primers 17 ca be exploded positively and reliably.

Now the function of the igniting apparatus according to the present invention will be explained with reference to several experiments effected by the apparatus according to the invention together with comparative experiments carried out by known apparatus having no shield housing.

EXPERIMENT 1

In the surface 18 of the exploding site there were formed four holes 19 having a diameter of 1.7 cm and a length of 40 cm. These holes 19 were formed at positions of corners of a square having a side of 30 cm. In each of the holes 19 there were inserted the dynamite 14 of 15 g and the igniting device 13 having the receiving antenna 15 formed by the dipole antenna of half wavelength, the signal cable 16 formed by the coaxial cable 3C2V having a length of 45 cm, and the detonating primer 17 formed by the No. 6 Detonator manufactured by NIPPON OIL AND FATS COMPANY, LIMITED. The oscillator 11 was formed by the magnetron oscillator for generating the microwave of the frequency of 2450 MHz. The transmitting antenna 12 was formed by the electromagnetic horn having the aperture diameter of 20 cm and a width of 30 cm. The shield housing 20 was made of iron housing having the diameter of 50 cm and the length of 1 m. One end of the shield housing was secured to the transmitting antenna 12 and the other end of the shield housing was urged against the surface 18 of the exploding site.

The magnetron oscillator 11 was continuously operated to generate the microwave of 100 W. Then, all the igniting devices 13 could be ignited and all the dynamites 14 were perfectly exploded. It was confirmed that during the operation, there was no leakage of the microwave out of the shield housing 20.

EXPERIMENT 2

In the surface 18 of the exploding site there were formed sixteen holes 19 which were arranged in 4×4 matrix. Each of the holes 19 had the diameter of 1.7 cm and the length of 60 cm. It should be noted that the distance between adjacent holes was 40 cm. In each of these holes 19 there were inserted the dynamite 14 of 20 g and the igniting device 13 including the receiving antenna 15 formed by the Yagi antenna which comprises a main element constructed by the folded-dipole of half wavelength, the signal transmission cable 16 formed by the parallel feeder having the length of 60 cm, and the detonating primer 17 formed by the blasting cap having the phenol resin which has the large dielectric constant and is decomposed by the microwave to generate heat. The oscillator 11 and transmitting antenna 12 were constructed by the magnetron and electromagnetic horn which were used in the first experiment 1. The shield housing 20 was formed to have the construction shown in FIG. 3. That is to say, the main body 20-1 was made of aluminum and the inner liner 20-2 was made of the electromagnetic wave absorbing material commercially available under the trade name of ECHOSORB AN-75 manufactured by GLACE COMPANY. The shield housing 20 had the height of 2 m, the width of 2 m and the length of 2 m. One end of the shield housing 20 was fixed to the electromagnetic horn 12 and the other end thereof was urged against the surface 18 of the exploding site.

When the microwave having the frequency of 2450 MHz and the power of 1000 W was radiated from the transmitting antenna 12 for 5/1000 seconds, all of the sixteen igniting devices 13 as well as all the dynamites 14 were perfectly exploded.

EXPERIMENT 3

In this experiment, use was made of the shield housing 20 having the inner liner 20-2 made of urethane resin having the thickness of 30 mm and having water immersed therein by 50 volume percentages. The remaining construction was the same as that of the second experiment. Under the same condition as that of the second experiment, all the sixteen detonating primers 17 were ignited and all the dynamites 14 were perfectly exploded.

EXPERIMENT 4

In this experiment, the inner liner 20-2 of the shield housing 20 was made of urethane resin having carbon black powder having a mean particle size of 30 μm mixed therein by 20 volume percentages. The remaining construction was the same as that of the second experiment. The experiment was carried out under the same condition as that of the second experiment. All the sixteen primers 17 and dynamites 14 were perfectly exploded.

COMPARATIVE EXPERIMENT

In this comparative experiment, the shield housing 20 was removed from the equipment used in the experiment 1. Under the same operational condition, four igniting devices were not ignited at all.

COMPARATIVE EXPERIMENT 2

In this comparative experiment 2, the shield housing in the equipment used in the experiment 2 was removed and the experiment was conducted under the same condition as that of the experiment 2. Only three detonating primers and dynamites were exploded, but the remaining thirteen detonating primers nd dynamites were not ignited.

It should be noted that in the above experiments use was made of the microwave in the UHF frequency range, but according to the present invention the electromagnetic wave within other frequency ranges such as the HF, VHF, SHF and EHF may be equally utilized to obtain similar results.

As explained above, according to the instant invention, the electromagnetic wave propagating space between the transmitting antenna ad the receiving antennas is surrounded by the shield housing which reflects or absorbs the electromagnetic wave, and thus the propagating path of the electromagnetic wave radiated by the transmitting antenna can be specified and the intensity of the electromagnetic field of the wave received by the receiving antennas can be maintained constant. Therefore, it is possible to transmit a sufficient amount of the electric power to the receiving antennas even if the oscillator has a small output power, so that the detonating primers connected to the receiving antennas can be ignited effectively. In this manner, according to the invention it is possible to effect the explosion positively and reliably.

The shield housing serves to prevent the leakage of the electromagnetic wave out of the housing as well as the intrusion of the spurious electromagnetic wave into the space within the housing, so that the influence of the electromagnetic wave upon the human beings, animals, plants and other electric equipment and the undesired explosion of the detonating primers can be removed.

Further, the noise, scattering stones and fumes due to the exploding can be confined within the shield housing, so that the explosion can be carried out without giving serious damages upon the environment.

What is claimed is:

1. An apparatus for igniting at least one detonating primer having a receiving antenna connected thereto with the aid of an electromagnetic wave comprising
   - an oscillator for generating an electric oscillation signal;
   - a transmitting antenna which is excited by said electric oscillation signal supplied from said oscillator to radiate an electromagnetic wave toward the receiving antenna connected to said detonating primer; and
   - a shield housing for surrounding a space between the transmitting antenna nd the receiving antenna connected to the detonating primer and having a property for reflecting or absorbing the electromagnetic wave which is made incident upon the shield housing.

2. An apparatus according to claim 1, wherein said shield housing is made of metal.

3. An apparatus according to claim 2, wherein said shield housing is made of metal selected from a group consisting of iron, aluminum and copper.

4. An apparatus according to claim 1, wherein said shield housing is made of dielectric material.

5. An apparatus according to claim 4, wherein said shield housing is made of the dielectric material. selected from a group consisting of titanium oxide and ferrite.

6. An apparatus according to claim 4, wherein said shield housing is made of resin having ferrite powder mixed therein.

7. An apparatus according to claim 4, wherein said shield hosing is made of resin having carbon powder mixed therein.

8. An apparatus according to claim 4, wherein said shield housing is made of urethane resin.

9. An apparatus according to claim 1, wherein said shield housing comprises a main body made of metal and an inner liner which is applied on an inner surface of the main body and has a property to absorb the electromagnetic wave.

10. An apparatus according to claim 9, wherein said inner liner is made of resin having water immersed therein.

11. An apparatus according to claim 9, wherein said inner liner is made of resin having ferrite powder mixed therein.

12. An apparatus according to claim 9, wherein said inner liner is made of resin having carbon power mixed therein.

13. An apparatus according to claim 1, wherein said oscillator is constructed to generate the electric signal having a frequency in a range of 10 MHz to 100 GHz.

14. An apparatus according to claim 13, wherein said oscillator comprises a magnetron for generating a microwave.

15. An apparatus according to claim 1, wherein said oscillator is constructed to radiate the electromagnetic wave having a power higher than 10 W.

16. An apparatus according to claim 1, wherein said transmitting antenna is formed by an antenna selected from a group consisting of electromagnetic horn, dipole antenna, Yagi antenna, ground-plane antenna and plane-antenna.

17. An apparatus according to claim 1, wherein said oscillator is constructed to generate the electric signal having a frequency in a range of 500 MHz to 20 GHz.

18. An apparatus according to claim 1, wherein said oscillator is constructed to radiate the electromagnetic wave having a power higher than 100 W.

19. An apparatus according to claim 1, wherein said oscillator is constructed to radiate the electromagnetic wave having a power higher than 1000 W.

* * * * *